US008528972B2

(12) United States Patent
Johnsson

(10) Patent No.: US 8,528,972 B2
(45) Date of Patent: Sep. 10, 2013

(54) FURNITURE UNIT

(75) Inventor: Per-Evert Johnsson, Lammhult (SE)

(73) Assignee: Lammhults Mobel AB, Lammhult (SE)

( * ) Notice: Subject to any disclaimer, the term of this patent is extended or adjusted under 35 U.S.C. 154(b) by 302 days.

(21) Appl. No.: 12/645,761

(22) Filed: Dec. 23, 2009

(65) Prior Publication Data

US 2010/0196088 A1 Aug. 5, 2010

(30) Foreign Application Priority Data

Feb. 2, 2009 (EP) ..... 09151864
Nov. 10, 2009 (EP) ..... 09175538

(51) Int. Cl.
*A47C 15/00* (2006.01)
*A47C 7/00* (2006.01)

(52) U.S. Cl.
USPC .. 297/248; 297/233; 297/440.14; 403/DIG. 1

(58) Field of Classification Search
USPC ..... 297/248, 440.14, 451.8, 233; 403/DIG. 1
See application file for complete search history.

(56) References Cited

U.S. PATENT DOCUMENTS 3,635,521 A 1/1972 Shivvers
5,061,112 A * 10/1991 Monford, Jr. ..... 403/328
6,824,220 B1 11/2004 Davison
7,025,522 B2 * 4/2006 Sicz et al. ..... 403/109.2
7,347,493 B2 * 3/2008 Mulmed ..... 297/233
7,708,349 B2 * 5/2010 Chen ..... 297/448.1
2006/0180055 A1 8/2006 Mulmed

FOREIGN PATENT DOCUMENTS

DE 3610225 A1 * 10/1987

OTHER PUBLICATIONS

Machine Translation of DE 3610225 A1 (Oct. 1, 1987), Espacenet, 2 pages.*
European Search Report dated Jul. 20, 2009 in corresponding European patent application No. 09151864.7, 3 pages.

* cited by examiner

*Primary Examiner* — David Dunn
*Assistant Examiner* — Tania Abraham
(74) *Attorney, Agent, or Firm* — Maier & Maier PLLC

(57) ABSTRACT

A furniture unit for building a furniture assembly together with another furniture unit comprises a first magnetic coupling member for interaction with a second magnetic coupling member of said another furniture unit. The first magnetic coupling member is movable between an inner position, in which it is retained by a retaining means, and an outer coupling position, to which it is movable from said inner position against a force from said retaining means.

8 Claims, 2 Drawing Sheets

FURNITURE UNIT

RELATED APPLICATIONS

This application claims priority under 35 U.S.C. §119, to European Patent Application Nos.: EP 09151864.7, filed on Feb. 2, 2009, and EP 09175538.9, filed on Nov. 10, 2009, the disclosures of which are incorporated by reference herein in their entireties.

TECHNICAL FIELD

The present invention relates to a furniture unit for building a furniture assembly together with another furniture unit, comprising a first magnetic coupling member for interaction with a second magnetic coupling member of said another furniture unit.

TECHNICAL BACKGROUND

U.S. Pat. No. 6,824,220 discloses a modular furniture where multiple furniture pieces are coupled together and maintained in a static relationship by means of magnetic coupling assemblies. This modular furniture has the drawback that magnetic fields of the magnetic coupling assemblies may interfere with items, such as e.g. electronic equipment, magnetic cards and passports. The function of items susceptible to magnetic fields may thus be influenced in a negative manner by furniture pieces of the type disclosed in U.S. Pat. No. 6,824,220.

SUMMARY OF THE INVENTION

It is an object of the present invention to overcome the above described drawbacks, and to provide an improved furniture unit.

This and other objects that will be apparent from the following summary and description are achieved by a furniture unit according to the appended claims.

According to one aspect of the present invention, there is provided a furniture unit for building a furniture assembly together with another furniture unit, comprising a first magnetic coupling member for interaction with a second magnetic coupling member of said another furniture unit, wherein said first magnetic coupling member being movable between an inner position, in which it is retained by a retaining means, and an outer coupling position, to which it is movable from said inner position against a force from said retaining means.

Due to the retaining force from the retaining means the magnetic coupling member of a furniture unit may thus be retained in an inner resting position as long as the furniture unit is not coupled to another furniture unit. This has the advantage that hazardous interference with items susceptible to magnetic fields, such as e.g. credit cards and electronic equipment, can be avoided although the furniture unit is provided with a magnetic coupling member having strong bonding capacity and thus surrounded by a magnetic field of significant strength. A furniture unit, adapted for coupling to another furniture unit in a very robust manner, may thus be used as a stand-alone unit, i.e. not coupled to another furniture unit, in a safe manner. Furthermore, hazardous interference with items susceptible to magnetic fields may be avoided during rearrangement of furniture units of a furniture assembly.

At the inner position the magnetic coupling member may thus be located sufficiently far away from the outer surface of the furniture unit in order to avoid hazardous interference with items located close to the furniture unit when it is not coupled to another furniture unit, e.g. when it is not used for building a furniture assembly together with another furniture unit or during rearrangement of furniture units of a furniture assembly.

Preferably, the retaining means comprises resilient means, arranged in such a manner that the magnetic coupling member is retained in an inner position by a force of the resilient means, in order to provide a very cost-effective furniture unit that can be assembled in an easy and failsafe manner.

The resilient means preferably comprises a compressed spring.

Preferably, the furniture unit further comprises stop means for limiting outward movement of said first magnetic coupling member.

Preferably, the stop means defines said outer coupling position.

It has been found that magnetic coupling members used for this purpose need to have certain magnetic bonding force to provide a robust coupling of furniture units when the furniture unit is used to build a furniture assembly.

Preferably the magnetic coupling member is a magnet and more preferably a rare earth magnet. This type of magnets is particularly suitable due to their strong bonding capacity. Thus, very robust coupling may be achieved.

Preferably the furniture unit further comprises means covering the magnetic coupling member. This has the advantage that the magnetic coupling member may be completely hidden. Furthermore, the covering protects the magnetic coupling member against dirt and dust.

In order to further improve the flexibility the furniture unit preferably comprises at least one further magnetic coupling member, said at least one further coupling member and the first magnetic coupling member being arranged on different sides of the furniture unit.

Further advantages of the invention will be apparent from the following description and the appended claims.

BRIEF DESCRIPTION OF THE DRAWINGS

The present invention will now be described in more detail with reference to the accompanying schematic drawings which show embodiments of the invention and in which.

DETAILED DESCRIPTION

Figure 1:
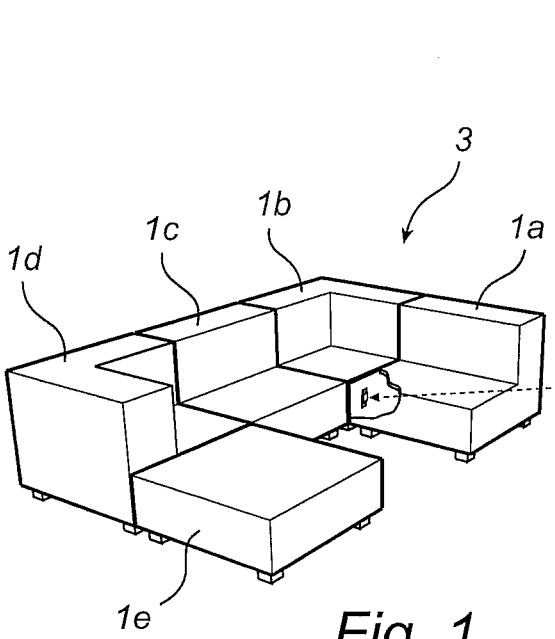
FIG. 1 shows a furniture assembly built from furniture units.

FIG. 1 shows five furniture units 1*a*-1*e* according to the present invention, which together form a furniture assembly 3.

Figure 2:
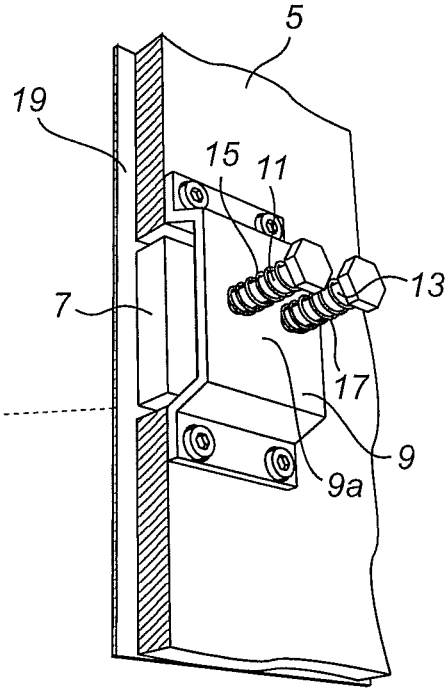
FIG. 2 shows a part of a furniture unit according to an embodiment of the present invention.

FIG. 2 shows a part of the furniture unit 1*a* which comprises a frame 5, a magnetic coupling member 7, a bracket 9 for connecting the magnetic coupling member 7 to the frame 5, guide pins 11, 13, resilient means 15, 17 and a covering 19. The magnetic member 7 is movable from an inner resting position, illustrated in FIG. 4*a*, to an outer coupling position, illustrated in FIG. 2 and in FIG. 4*b*.

Figure 3:
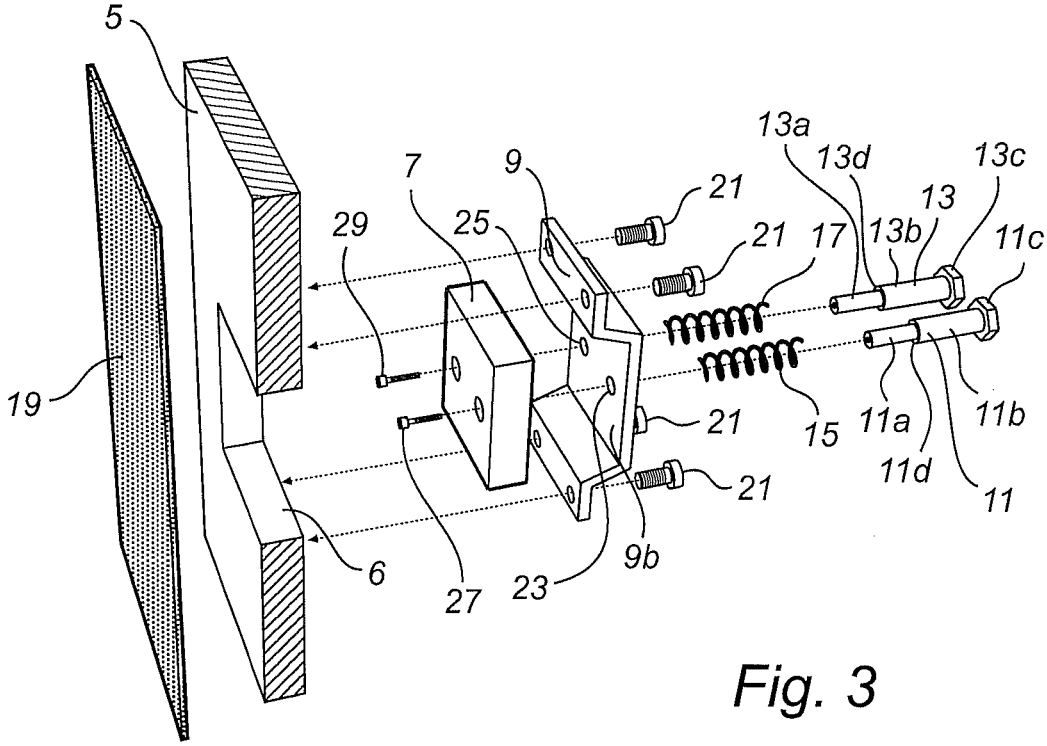
FIG. 3 shows the part of a furniture unit shown in FIG. 2 in an exploded view.

FIG. 3 shows the part of furniture unit 1*a* in an exploded view to clearly illustrate how the magnetic coupling member 7 is connected to the furniture unit frame 5. The bracket 9 is fastened to the frame 5, which in this case comprises a solid wooden plate, by means of four screws 21. A first guide pin 11 is inserted through a first hole 23 in the bracket 9 and fastened to the magnetic coupling member 7 by a screw 27. A second guide pin 13 is inserted through a second hole 25 in the bracket 9 and fastened to the magnetic coupling member 7 by a screw 29. The frame 5 has an opening 6 through which the magnetic coupling member 7 can be moved from its inner position, in which the magnetic member 7 is spaced from the covering 19, to its outer coupling position, in which the magnetic coupling member 7 is in contact with the covering 19. The covering 19 is in this case formed by a fabric that protects the magnetic coupling member 7 and forms an outer surface of the furniture unit 1*a*.

Each of the guide pins 11, 13 has an end portion 11*a*, 13*a* with a smaller diameter $D_1$, a central portion 11*b*, 13*b* with a larger diameter $D_2$ and a head portion 11*c*, 13*c*. At the diameter transition of each guide pin 11, 13 a shoulder 11*d*, 13*d*, respectively, is formed, see FIG. 3. Each of the holes 23, 25 has a diameter $D_3$ which is larger than $D_1$ and smaller than $D_2$, i.e. $D_1<D_3<D_2$. Since $D_3<D_2$ the shoulders 11*d*, 13*d* limit outward movement of the magnetic coupling member 7, i.e., in a direction towards the covering 19. The shoulders 11*d*, 13*d* thus prevent the magnetic coupling member 7 from further outward movement once the outer coupling position is reached. The movement of the magnetic coupling member 7 is guided by the guide pins 11, 13. When the magnetic coupling member 7 is in the coupling position the shoulders 11*d*, 13*d* abut against the bracket surface 9*a* facing inwards.

The furniture unit 1*a* comprises retaining means for retaining the magnetic coupling member 7 in its inner position when the furniture unit 1*a* is not coupled to another furniture unit, e.g. when the furniture unit 1*a* is used as a stand-alone unit. In this embodiment the retaining means comprises a first resilient member, in the form of a compression spring 15, which is arranged around the central portion 11*b* and end portion 11*a* of the guide pin 11. The first compression spring 15 is interposed between the bracket 9 and the head portion 11*c* of the guide pin 11 to exert a force urging the bracket 9 and the head portion 11*c* away from each other. The retaining means further comprises a second resilient member, in the form of a compression spring 17, which is arranged around the central portion 13*b* and end portion 13*a* of the second guide pin 13. The second compression spring 17 is interposed between the bracket 9 and the head portion 13*c* of the guide pin 13 to exert a force urging the bracket 9 and the head portion 13*c* away from each other. The compression springs 15, 17 thus together form a resilient means capable of retaining the magnetic coupling member 7 in its inner position.

Each of the guide pin head portions 11*c*, 13*c* is in this case formed by a bolt head. The head portion 11*c* forms a stop for one end of the first compression spring 15 and the head portion 13*c* forms a stop for one end of the second compression spring 17. A part of the bracket surface 9*a* facing towards the guide pin head portions 11*c*, 13*c* forms an abutment surface for each of the other ends of the compression springs 15, 17. One end of each of the springs 15, 17 thus abuts against the bracket 9 and the other end of each of the springs 15, 17 abuts against the head portion 11*c*, 13*c* of a guide pin 11, 13. The force from each of the compressed springs 15, 17 acts to push the guide pin head portions 11*c*, 13*c* in a direction away from the bracket 9. Consequently, the magnetic coupling member 7, which is fastened to the guide pins 11, 13 by screws 27, 29 respectively, is biased against the bracket surface 9*b* facing the covering 19. The magnetic coupling member 7 may be retained in this inner position as long as the magnetic coupling member 7 does not interact magnetically with a magnetic coupling member of another furniture unit.

In order to achieve a robust coupling of furniture units when building a furniture assembly the magnetic interaction between the first magnetic coupling member 7 and a magnetic coupling member of another furniture unit need to be strong. The magnetic coupling member 7 is therefore preferably a rare earth magnet, which has very strong bonding capacity. For instance a disc-shaped neodymium magnet may be used. The magnetic coupling member 7 is in this case a neodymium magnet covered by a rubber coating.

Rare earth magnets are permanent magnets made from alloys of rare earth elements. Rare earth magnets are substantially stronger than for instance ferrite magnets. A neodymium magnet is a permanent magnet ($Nd_2Fe_{14}B$) made of an alloy of neodymium, iron and boron, which has very strong magnetic bonding properties.

The furniture unit 1*a* may be provided with a further magnetic coupling member arranged at the same side of the furniture unit as the magnetic coupling member 7, in order to even further improve the coupling robustness when the furniture unit is coupled to another furniture unit. Furthermore, the furniture unit 1*a* may be provided with one or more further magnetic coupling members at the opposite side thereof in order to be adapted to be coupled to further furniture units.

Figure 4A:
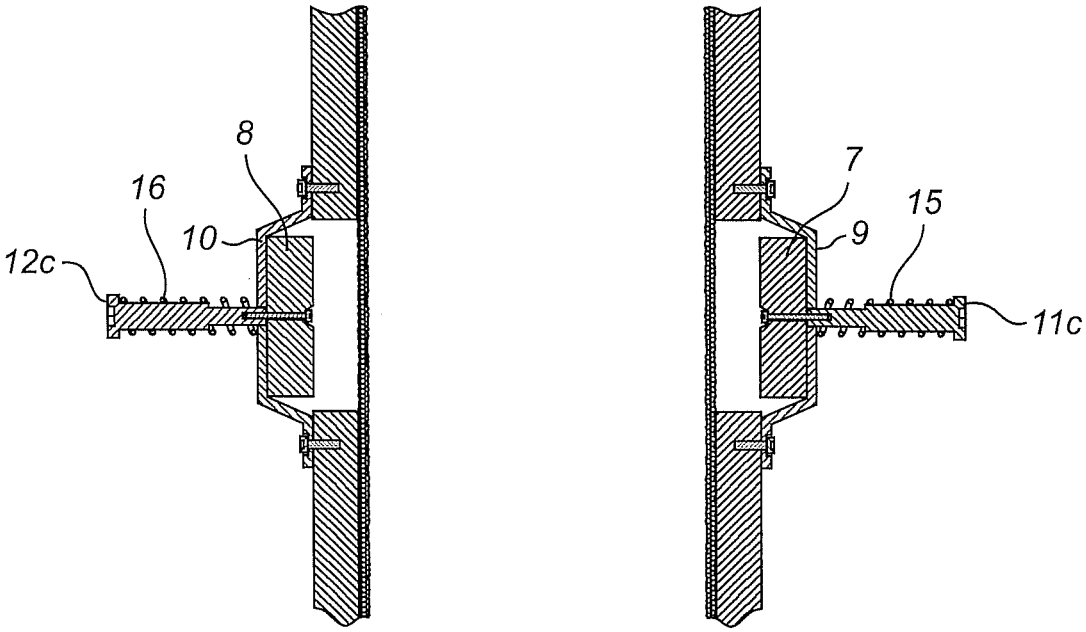
FIG. 4*a* shows parts of two furniture units of the assembly shown in FIG. 1 in a sectional view in which the furniture units have been separated from each other.
Figure 4B:
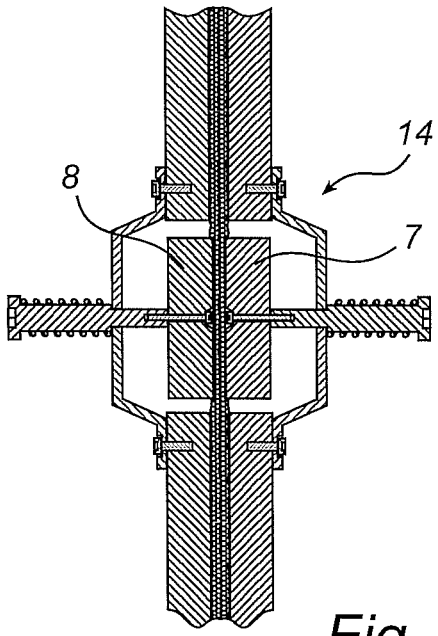
FIG. 4*b* shows, in a sectional view, a coupling region of the seating furniture assembly shown in FIG. 1.

When the furniture unit 1*a* is arranged close to another furniture unit having a complementary magnetic coupling member the attracting force between the magnetic coupling members causes an outward movement of the coupling member 7 from its inner resting position to its outer coupling position, illustrated in FIG. 4*b*. The magnetic coupling member 7 of furniture unit 1*a* is thus movable from an inner position, shown in FIG. 4*a*, to an outer coupling position in response to magnetic interaction with a magnetic coupling member of another furniture unit 1*b*.

FIG. 4*a* shows parts of the furniture units 1*a* and 1*b* shown in FIG. 1 in a state where the furniture units 1*a*, 1*b* are separated from each other. The furniture unit 1*b* is provided with a magnetic coupling member 8 which is identical to, and arranged in the same manner as, the coupling member 7 of furniture unit 1*a*, see FIG. 4*a*. The second furniture unit 1*b* thus also comprises a bracket fastened to a frame of the furniture unit 1*b*, guide pins fastened to the magnetic coupling member 8 and resilient retaining means for retaining the magnetic coupling means 8 in its inner position when not coupled to another furniture unit. The second furniture unit 1*b* is thus provided with a magnetic coupling member 8 which is movable from an inner position, illustrated in FIG. 4*a*, to an outer coupling position, illustrated in FIG. 4*b*. In FIG. 4*a* each of the magnetic coupling members 7, 8 of the furniture units 1*a*, 1*b* is retained in an inner position due to the action of compression springs 15, 16, each of which is arranged between a bracket 9, 10 and guide pin head portions 11*c*, 12*c* of the furniture unit 1*a* and 1*b* respectively.

In order to illustrate coupling of the furniture unit 1*a* to another furniture unit 1*b* a coupling region of the furniture assembly 3 is shown in FIG. 4*b*. In this coupling region a magnetic coupling member 7 of furniture unit 1*a* interacts magnetically with a magnetic member 8 of furniture unit 1*b*. The coupling members 7, 8 of furniture units 1*a* and 1*b* are arranged in such a manner that they face each other and thus interact with each other when the furniture units are located close to each other, as illustrated in FIG. 4*b*. The furniture units 1*a* and 1*b* are thus releasably coupled to each other by means of a magnetic coupling means 14 comprising two magnetic coupling members 7, 8.

When the magnetic coupling member 7 of the furniture unit 1*a* interacts with a magnetic coupling member of another furniture unit the retaining force of the resilient means 15, 17 is not large enough to retain the magnetic coupling member 7 in its inner position. On the other hand when a magnetic coupling member 7 of the furniture unit does not interact magnetically with a member of another furniture unit the magnetic member 7 is retained in its inner position due to the action of the resilient means 15, 17.

When the magnetic member 7 is retained in its inner position, the magnetic field therefrom is low at the outer surface of the covering layer 19 compared to the magnetic field at this location when the magnetic member 7 is located in its outer coupling position. The distance the magnetic coupling member 7 is moved between the inner and outer position may be optimized in such a manner that the magnetic field at the outer surface of the furniture unit 1*a* is harmless to items located at the furniture unit surface. The force from the resilient members 15, 17 is large enough to retain the magnetic member 7 in its inner resting position as long as the magnetic coupling member 7 is not interacting with another magnetic coupling member. In response to a force, which is larger than the retaining force of the resilient means, the magnetic coupling member is movable outwards, i.e. in a direction towards the protecting fabric 19. In this case the attracting force of the magnetic coupling means 14 coupling the two furniture units 1*a* and 1*b* together is about 280 N. The neodymium magnets of the magnetic coupling means 14 thus together have a bonding force of about 280N.

In an alternative embodiment the retaining means may comprise a magnetic coupling member in the form of a magnetic element, such as a steel plate, arranged on the bracket surface facing the magnetic coupling member or formed as an integral part of the bracket. This embodiment differs from the above described embodiment in that the magnetic member is retained in its inner position due to magnetic interaction between the magnetic coupling member and a magnetic element instead of due to a force from resilient means. Resilient means are thus not needed in this embodiment. It is realized that the attracting force between the magnetic coupling member and the magnetic element of the retaining means need to be weaker than the attracting force between the magnetic coupling member and a magnetic coupling member of another furniture unit to which the furniture unit may be coupled.

A furniture unit 1*a* may be coupled to another furniture unit for building a furniture assembly as illustrated in FIG. 1, which shows a furniture assembly 3 comprising five furniture units 1*a*-1*e*. The furniture units 1*c*-1*e* of furniture assembly 3 are provided with magnetic coupling members of the same type and arranged in the same manner as the magnetic coupling member of furniture unit 1*a*. Alternatively, a furniture unit of a furniture assembly may be provided with a magnetic coupling member in the form of a magnetic element, such as a steel plate. It is realized that a large number of different furniture assemblies may be built from individual furniture units.

It will be appreciated that the described embodiments of the invention can be modified and varied by a person skilled in the art without departing from the inventive concept defined in the claims.

It is for instance realized that the furniture unit 1*a* may be provided with further magnetic coupling members connected to the frame 5 in a similar or identical manner to provide particularly good coupling robustness and/or flexibility of a furniture unit when the furniture unit is used together with other furniture units to build a furniture assembly.

In FIG. 4*b* coupling of the furniture unit 1*a* to a second furniture unit provided with the same type of coupling member is illustrated. It is however realized that the furniture unit 1*a* may be coupled to a furniture unit provided with another type of magnetic coupling member arranged in another way, such as, for instance, a steel plate fastened to a frame of the furniture unit by means of screws.

The magnetic coupling member 7 of furniture unit 1*a* is retained by two compression springs 15, 17 arranged around two guide pins 11, 13 respectively. Alternatively, the magnetic coupling member 7 may be retained by one single compression spring arranged around a guide pin.

The invention claimed is:

1. Furniture unit for building a furniture assembly together with another furniture unit, comprising:

a furniture unit for seating, said furniture unit having a frame, an outer covering surface and a first magnetic coupling member for interaction with a second magnetic coupling member of said another furniture unit with seating independent of said furniture unit, wherein said first magnetic coupling member being movable relative to said frame between an inner position, in which it is retained by a retaining means, and an outer coupling position proximate the outer covering surface, to which it is movable from said inner position against a force from said retaining means.

2. Furniture unit according to claim 1, wherein said retaining means comprises a resilient means.

3. Furniture unit according to claim 2, wherein said resilient means comprises a spring element.

4. Furniture unit according to claim 1, further comprising stop means for limiting outward movement of said first magnetic coupling member.

5. Furniture unit according to claim 4, wherein said stop means define said outer coupling position.

6. Furniture unit according to claim 1, wherein at least one of said first magnetic coupling member and said second magnetic coupling member comprises a rare earth magnet.

7. Furniture unit according to claim 1, further comprising means covering at least one of said first magnetic coupling member and said second magnetic coupling member.

8. Furniture unit according to claim 1, wherein the furniture unit comprises at least one further magnetic coupling member, said at least one further magnetic coupling member and the first magnetic coupling member being arranged on different sides of the furniture unit.

* * * * *